US010053342B2

(12) United States Patent
Ishikawa et al.

(10) Patent No.: US 10,053,342 B2
(45) Date of Patent: Aug. 21, 2018

(54) CHAIN BLOCK

(71) Applicant: KITO CORPORATION, Nakakoma-gun, Yamanashi (JP)

(72) Inventors: Kazumitsu Ishikawa, Yamanashi (JP); Hiroki Sano, Yamanashi (JP); Kosuke Kosuga, Yamanashi (JP)

(73) Assignee: KITO CORPORATION, Yamanashi (JP)

( * ) Notice: Subject to any disclaimer, the term of this patent is extended or adjusted under 35 U.S.C. 154(b) by 17 days.

(21) Appl. No.: 14/413,333

(22) PCT Filed: Jul. 29, 2013

(86) PCT No.: PCT/JP2013/070457
§ 371 (c)(1),
(2) Date: Jan. 7, 2015

(87) PCT Pub. No.: WO2014/021254
PCT Pub. Date: Feb. 6, 2014

(65) Prior Publication Data

US 2015/0191335 A1 Jul. 9, 2015

(30) Foreign Application Priority Data

Jul. 30, 2012 (JP) ..... 2012-168499

(51) Int. Cl.
*B66D 3/16* (2006.01)

(52) U.S. Cl.
CPC ..... *B66D 3/16* (2013.01)

(58) Field of Classification Search
CPC ... B66D 3/16; B66D 3/14; B66D 3/18; B66D 3/20
See application file for complete search history.

(56) References Cited

U.S. PATENT DOCUMENTS 2,623,731 A * 12/1952 Kamlukin ..... B66D 3/16 254/345
3,092,369 A * 6/1963 Carroll ..... B66D 3/16 254/343

(Continued)

FOREIGN PATENT DOCUMENTS

CA 2136558 A1 6/1995
CN 2137249 Y 6/1993

(Continued)

OTHER PUBLICATIONS

Extended European Search Report corresponding to Application No. 13826094.8-1705/2881355 PCT/JP2013/070457; dated Feb. 24, 2016.

(Continued)

*Primary Examiner* — William E Dondero
*Assistant Examiner* — Nathaniel L Adams
(74) *Attorney, Agent, or Firm* — Cantor Colburn LLP

(57) ABSTRACT

Provided is a chain block with which a reduction in size can be achieved while inhibiting a reduction in strength. A chain clock is provided with: a load-sheave hollow shaft which is provided with a load sheave that rotates to feed a load chain, said load-sheave hollow shaft having a hollow core along the axial direction thereof; a drive shaft which is inserted into the hollow core, and which is provided with a flange portion protruding radially outward from one end side to a base side of a separate gear part; and a reduction gear member provided with first reduction gear part which meshes with the gear part. An accommodating recess is provided at the one end side of the hollow core, said accommodating recess having a bottom part which is where the flange part is positioned, and which is in contact with the flange part. An inclined portion, which gradually inclines further towards the gear part side as said inclined portion approaches a center side in the radial direction, is provided (Continued)

to the flange portion. A chamfered portion is provided to a side of the reduction gear member, said side being the side nearest the flange portion.

9 Claims, 13 Drawing Sheets

(56) References Cited

U.S. PATENT DOCUMENTS

| | | | | | |
|---|---|---|---|---|---|
| 4,221,364 | A * | 9/1980 | Nishimura | B66D 3/16 | 24/116 R |
| 4,605,111 | A * | 8/1986 | Ohno | B66D 3/22 | 192/15 |
| 4,690,379 | A * | 9/1987 | Nakamura | B66D 3/18 | 192/223.4 |
| 5,544,863 | A | 8/1996 | Ueno et al. | | |
| 5,556,078 | A | 9/1996 | Kubota et al. | | |
| 5,566,925 | A * | 10/1996 | Wada | B66D 3/16 | 254/358 |
| 5,570,872 | A | 11/1996 | Inoue et al. | | |
| 5,586,751 | A | 12/1996 | Ueno et al. | | |
| 5,586,752 | A * | 12/1996 | Wada | B66D 3/16 | 254/372 |
| 5,769,398 | A * | 6/1998 | Samejima | B66D 3/14 | 192/95 |
| 6,224,039 | B1 * | 5/2001 | Okamoto | B66D 3/16 | 254/346 |
| 6,578,824 | B2 * | 6/2003 | Samejima | B66D 3/10 | 254/352 |
| 7,401,765 | B2 * | 7/2008 | Xia | B66D 3/14 | 254/350 |
| 2013/0001489 | A1 | 1/2013 | Ishikawa | | |

FOREIGN PATENT DOCUMENTS

| | | | |
|---|---|---|---|
| CN | 1096763 | A | 12/1994 |
| CN | 1103143 | A | 5/1995 |
| CN | 1110247 | A | 10/1995 |
| CN | 1111596 | A | 11/1995 |
| EP | 0131380 | A1 | 6/1984 |
| JP | 57-151395 | U | 3/1956 |
| JP | 59-195193 | U | 12/1984 |
| JP | H07157290 | B2 | 6/1995 |
| JP | 2006-56674 | A | 3/2006 |
| JP | 2011-201637 | A | 10/2011 |
| WO | 2011118666 | A1 | 9/2011 |

OTHER PUBLICATIONS

International Search Report Corresponding to Application No. PCT/JP2013/070457; dated Oct. 8, 2013.

Chinese Notification of the First Office Action corresponding to Patent No. 201380034226.7; dated Nov. 4, 2015, with English translation.

* cited by examiner

CHAIN BLOCK

This is the U.S. national stage of application No. PCT/JP2013/070457, filed on Jul. 29, 2013. Priority under 35 U.S.C. § 119(a) and 35 U.S.C. § 365(b) is claimed from Japanese Application No. 2012-168499, filed Jul. 30, 2012, the disclosure of which is also incorporated herein by reference.

TECHNICAL FIELD

The present invention relates to a chain block for use in a load hoisting work.

BACKGROUND ART

In order to move a load in an up-down direction, a chain block is generally used. The chain block includes a hand wheel, a wheel cover, a main body portion, and the like. The main body portion is provided with a load sheave around which a load chain is wound. Then, when a hand chain wound around the hand wheel is wound up, the hand wheel rotates, and the rotation of the hand wheel is transmitted to the load sheave through a predetermined transmission mechanism including gears and the like. Thereby, the load hung on a lower hook is moved in an upward direction. Conversely, when the hand chain is wound down in a state where the load is positioned in the upper side, the load is moved in a downward direction. Such a chain block is disclosed in, for example, Patent Literature 1 and Patent Literature 2.

CITATION LIST

Patent Literature

[PTL 1]: JP 59-195193 Y
[PTL 2]: JP 2011-201637 A

SUMMARY OF INVENTION

Technical Problem

Meanwhile, to improve portability, easiness of attachment and detachment, and the like of the chain block, it is desirable to promote size reduction of the chain block. However, mere size reduction of the chain block brings about a problem of a decrease in strength of the chain block.

The present invention is achieved based on the above circumstances, and an object thereof is to provide a chain block enabling achievement of size reduction while inhibiting a decrease in strength.

Solution to Problem

To solve the above problems, according to a first aspect of the present invention, a chain block is provided including a load-sheave hollow shaft around which a load chain is wound, which includes a load sheave feeding the load chain along with rotation, and which includes a hollow hole passing therethrough along an axial direction, a drive shaft which is inserted in the hollow hole, which includes on a first end side a gear portion meshing with a reduction gear member, and which has on a base end side of the gear portion away from the first end side a flange portion projecting to an outer circumferential side, and the reduction gear member including a first reduction gear portion meshing with the gear portion. On a first end side of the hollow hole is provided a housing recess including a bottom portion on which the flange portion is situated and abuts. The flange portion is provided toward a center side in a radial direction with an inclined portion gradually inclined toward a side of the gear portion. On a side of the first reduction gear portion in proximity to the flange portion is provided a chamfered portion.

Also, according to another aspect of the present invention, in the aforementioned invention, the load-sheave hollow shaft is preferably provided with a load gear meshing with a second reduction gear portion out of the reduction gear member and rotated integrally with the load-sheave hollow shaft, and this load gear preferably abuts in a state in which movement thereof along a second end side in the axial direction is regulated by a fixing step of the load-sheave hollow shaft. On a center side in the radial direction at least on one end surface side of the load gear is preferably provided a recess further dented than on an outer circumferential side.

Further, according to another aspect of the present invention, in the aforementioned invention, the reduction gear member is preferably provided with the first reduction gear portion having a chamfered portion, the second reduction gear portion meshing with the load gear. The first reduction gear portion is preferably provided with expanding portions projecting from an opposite end surface thereof of the second reduction gear portion, and a pivotally supporting portion preferably projects from the expanding portions toward a direction away from the first reduction gear portion. The expanding portions preferably expand outward in the radial direction so as to have larger diameters than that of the pivotally supporting portion and preferably expand intermittently along a circumferential direction, and between the adjacent expanding portions are preferably provided a plurality of dented portions each having a smaller diameter than that of the expanding portion. On an outer circumferential side of the pivotally supporting portion is preferably provided a groove along the axial direction of the reduction gear member, and this groove preferably communicates with at least one of the dented portions.

Still further, according to another aspect of the present invention, in the aforementioned invention, a thickness of a tip of a tooth of the gear portion in the drive shaft is preferably set to be larger than a thickness of a tip of a tooth of the first reduction gear portion of the reduction gear member.

Still further, according to another aspect of the present invention, in the aforementioned invention, to the frame member is preferably rotatably supported a pair of guide rollers guiding feeding of the load chain together with the load sheave. The guide rollers as the pair are preferably arranged at symmetric positions with a rotation center of the drive shaft interposed therebetween. The guide rollers as the pair are preferably arranged so that, as a result of entire turning in load hoisting with use of the load chain, a line connecting the guide rollers as the pair may be further nearly horizontal than in an unloaded case in the load hoisting.

Still further, according to another aspect of the present invention, in the aforementioned invention, the load-sheave hollow shaft is preferably pivotally supported in an insertion hole of the frame member. To the frame member is preferably attached via fixing tools a plate member having a center hole provided coaxially with the insertion hole. The plate member is preferably provided with a flange portion abutting on the frame member and a draw portion situated further on a center side than the flange portion and raised from the flange portion so as to be spaced apart from the frame member. The plate member is preferably attached to the frame member at the flange portion via the fixing tools. A pair of fixing tools is preferably provided on each side with the rotation center of the drive shaft interposed therebetween. The fixing tools as each pair are preferably provided at positions at which, as a result of entire turning in load hoisting with use of the load chain, a line connecting the fixing tools as each pair further approaches to a direction perpendicular to an acting line of a force at the time of load hoisting than in an unloaded case.

Advantageous Effects of Invention

According to the present invention, a chain block enables achievement of size reduction while inhibiting a decrease in strength.

DESCRIPTION OF EMBODIMENTS

Figure 1:
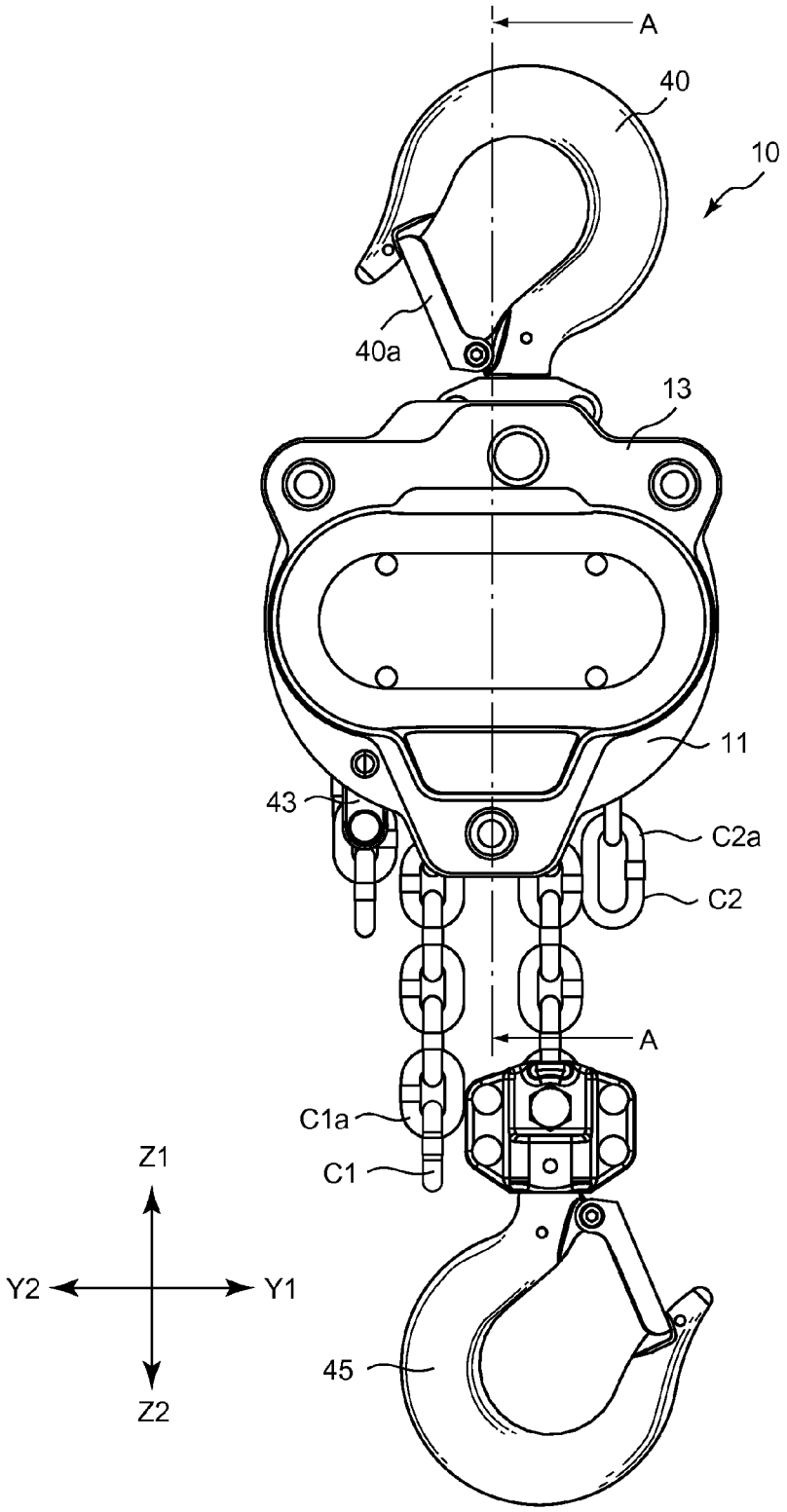
FIG. 1 is a front view illustrating an appearance of a chain block according to an embodiment of the present invention.

Hereinbelow, a chain block according to an embodiment of the present invention will be described with reference to the drawings.

<1. Regarding Configuration of Chain Block>

As illustrated in FIGS. 1 to 4 and the like, a chain block 10 includes a first frame 11, a second frame 12, a gear case 13, a wheel cover 14, a load-sheave hollow shaft 20, and a speed reducing mechanism 30, and these are fixed via stud bolts SB and nuts N. Then, between the first and second frames 11 and 12, between the first frame 11 and the gear case 13, and between the second frame 12 and the wheel cover 14, respective members are mounted; however, a part of the members protrude from therebetween. Hereinafter, the respective members will be described.

Figure 3:
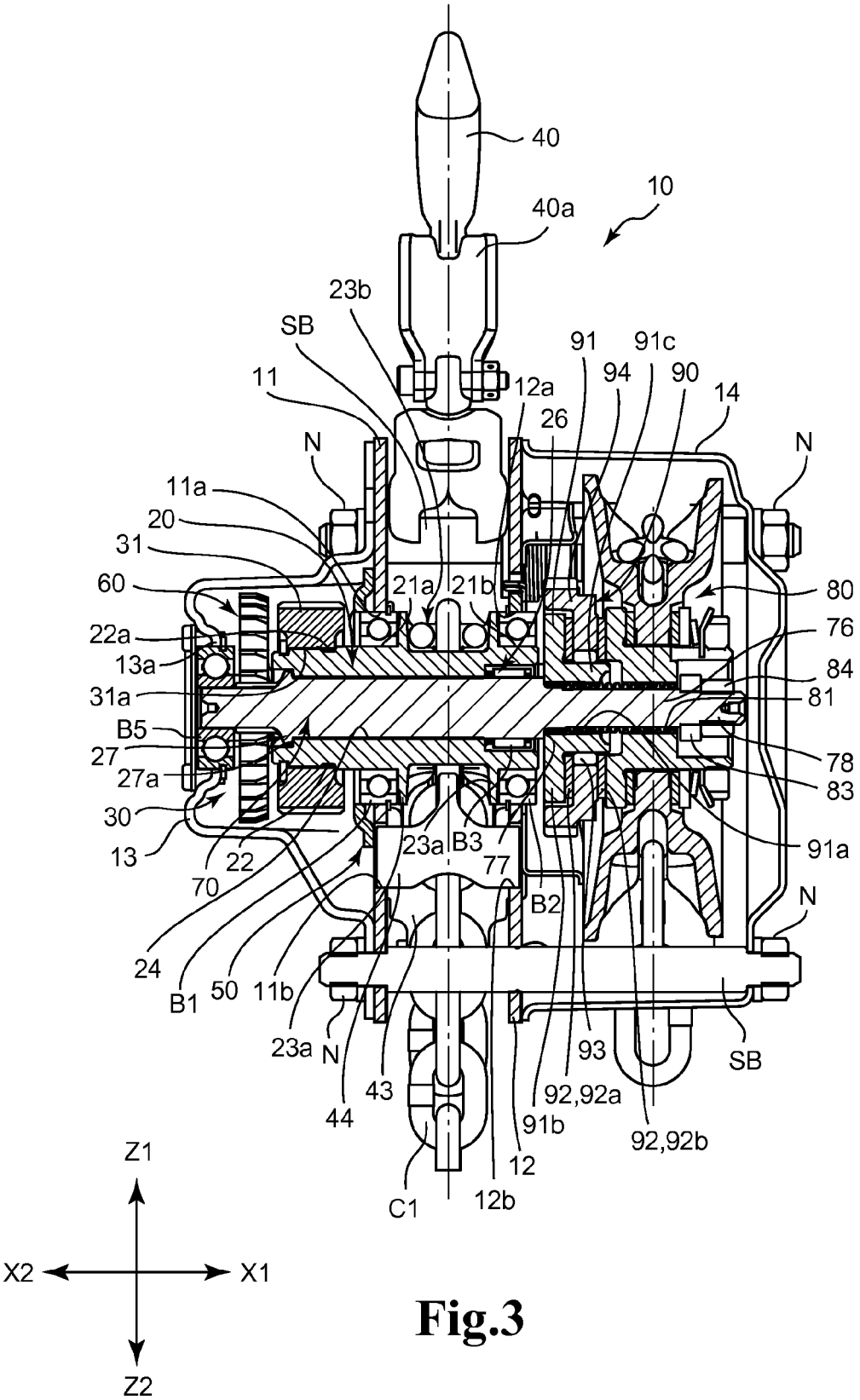
FIG. 3 is a side cross-sectional view illustrating a state in which the chain block has been cut along the line A-A in FIG. 1.
Figure 4:
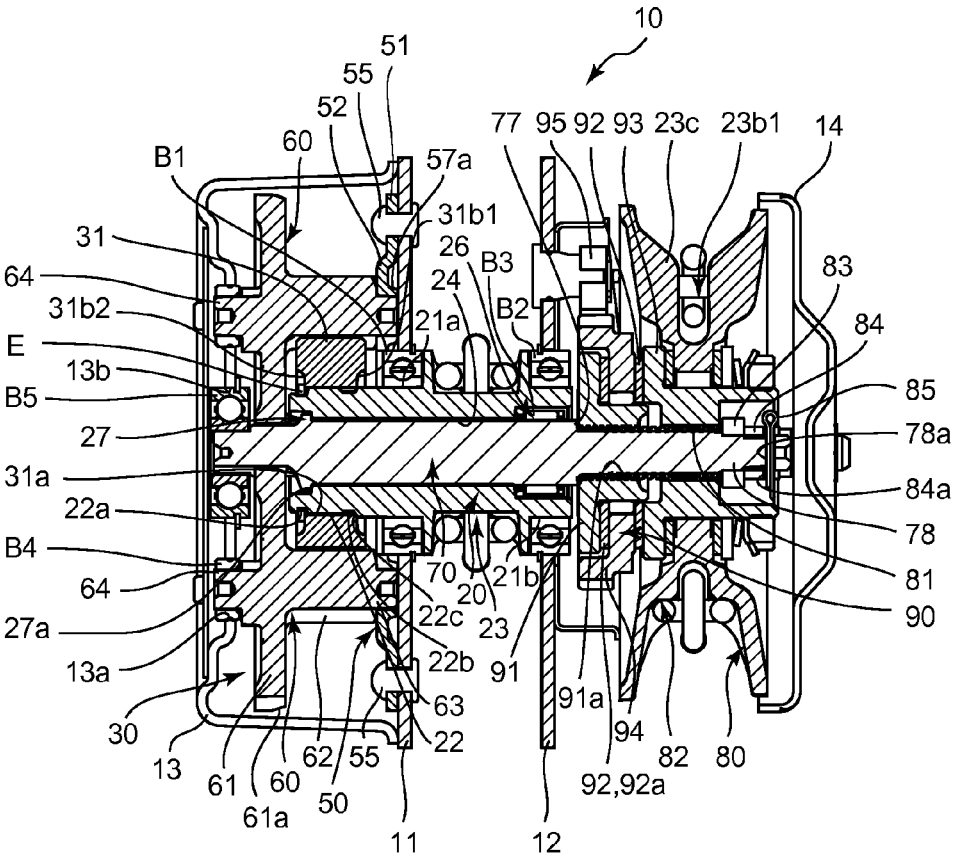
FIG. 4 is a side cross-sectional view illustrating a state in which the chain block has been cut along the line B-B in FIG. 2.
Figure 4:
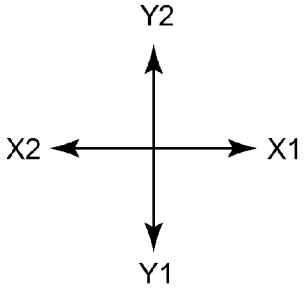

Between the first and second frames 11 and 12, a part of the load-sheave hollow shaft 20, an upper hook 40, a guide roller 42, a metal fastener 43, a stripper 44, and the like are positioned. As illustrated in FIGS. 3 and 4, the load-sheave hollow shaft 20 is supported by the first and second frames 11 and 12 through bearings B1 and B2 such as ball bearings, which are fitted into insertion holes 11*a* and 12*a* of the first and second frames 11 and 12, respectively. That is, the bearings B1 and B2 are positioned in outer peripheries of bearing fitting portions 21*a* and 21*b* of the load-sheave hollow shaft 20, and further the bearings B1 and B2 are positioned in the insertion holes 11*a* and 12*a*. Thereby, the load-sheave hollow shaft 20 is supported by the first and second frames 11 and 12.

Also, a gear fitting portion 22 is provided closer to the gear case 13 side than the bearing fitting portion 21*a* on the first frame 11 side of the load-sheave hollow shaft 20, and a load gear 31 forming the speed reducing mechanism 30 is held in a spline-coupled state by the gear fitting portion 22. Note that the gear case 13 side of the gear fitting portion 22 is provided with a groove portion 22*a* to which a snap ring E is mounted. By the snap ring E mounted to the groove portion 22*a*, the load gear 31 is restricted from moving toward the X2 side of the load gear 31. On the other hand, a clearance groove 22*b* for a spline process is formed at a site on the bearing fitting portion 21*a* side of the gear fitting portion 22, and further a fixation stepped portion 22*c* having a larger diameter than that of the gear fitting portion 22 is provided at a site closer to the bearing fitting portion 21*a* side than the clearance groove 22*b*. The fixation stepped portion 22*c* restricts the load gear 31 from moving toward the X1 side.

Here, the load gear 31 is provided with a central hole 31*a* into which the above-described gear fitting portion 22 is inserted. In addition, as illustrated in FIGS. 3 and 4, concave portions 31*b* are provided around the central hole 31*a* on each end side of the load gear 31. The concave portions 31*b* are provided in the shape of recessing each end surface of the load gear 31 by a predetermined depth. That is, as illustrated in FIGS. 3 and 4, a concave portion 31*b*1 recessed from the end surface on the X1 side of the load gear 31 faces the bearing B1. However, the existence of the concave portion 31*b*1 can increase clearance between the load gear 31 and the bearing B1. Thereby, when the load gear 31 rotates in a state where machine oil (grease) exists between the load gear 31 and the bearing B1, a mechanical loss caused by the viscosity of the machine oil (grease) when the load gear 31 rotates can be reduced, and the fluidity of machine oil (grease) can be improved. Similarly, a concave portion 31*b*2 recessed from the end surface on the X2 side of the load gear 31 faces a large-diameter gear 61 of a reduction gear member 60. However, the existence of the concave portion 31*b*2 can increase clearance between the load gear 31 and the large-diameter gear 61. Also in this case, when the load gear 31 rotates, a mechanical loss caused by the viscosity of machine oil (grease) when the load gear 31 rotates can be reduced, and the fluidity of the machine oil (grease) can be improved.

Furthermore, the load-sheave hollow shaft 20 has a pair of flange portions 23*a* forming the load sheave 23, and further has a chain pocket 23*b* (refer to FIG. 4) forming the load sheave 23 between the pair of flange portions 23*a*. The chain pocket 23*b* is a portion into which a metal hoop C1*a* of a load chain C1 is fitted, and has a horizontal pocket (not illustrated) into which the metal hoop C1*a* is fitted in a state where the direction in which the metal hoop C1*a* becomes flat is parallel to the axial direction (X direction), and a vertical pocket (not illustrated) which has a deeper groove shape than the horizontal pocket and into which the metal hoop C1*a* is fitted in a state where the direction in which the metal hoop C1*a* becomes flat crosses the axial direction (X direction).

Furthermore, the load-sheave hollow shaft 20 is provided with a hollow hole 24. A drive shaft 70 is inserted into the hollow hole 24, and an end portion on the second frame 12 side of the hollow hole 24 is provided with a bearing stepped portion 26 for receiving a bearing B3 which shaft-supports the drive shaft 70. Here, an end portion on the gear fitting portion 22 side of the hollow hole 24 is provided with a receiving concave portion 27 for receiving a flange portion 71 of the drive shaft 70. By the flange portion 71 of the drive shaft 70 positioned in the receiving concave portion 27, the length along the axial direction (X direction) of the drive shaft 70 can be reduced, and the dimension along the X direction (the axial direction of the drive shaft 70) of the chain block 10 can be reduced. Furthermore, By the reduced length along the axial direction of the drive shaft 70, the strength of the drive shaft 70 can be improved.

As illustrated in FIGS. 1 to 5, the upper hook 40 is mounted to the first and second frames 11 and 12 through a connecting shaft 41 (refer to FIGS. 5 and 7), and mounted in a rotatable state with respect to the connecting shaft 41. A hook latch 40*a* which is biased in a closing direction by a basing unit (not illustrated) is mounted to the upper hook 40.

Figure 2:
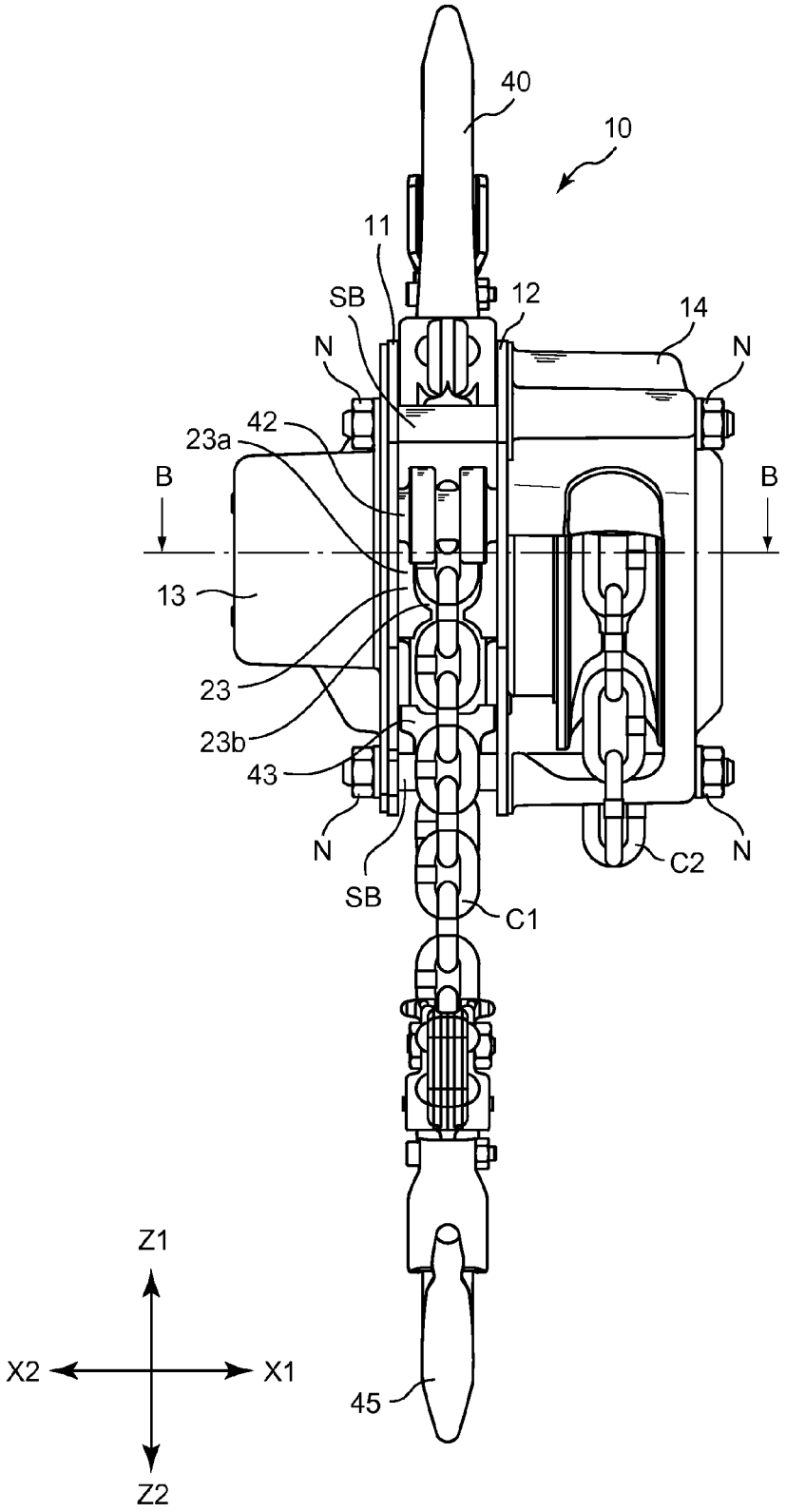
FIG. 2 is a side view illustrating the appearance of the chain block in FIG. 1.
Figure 7:
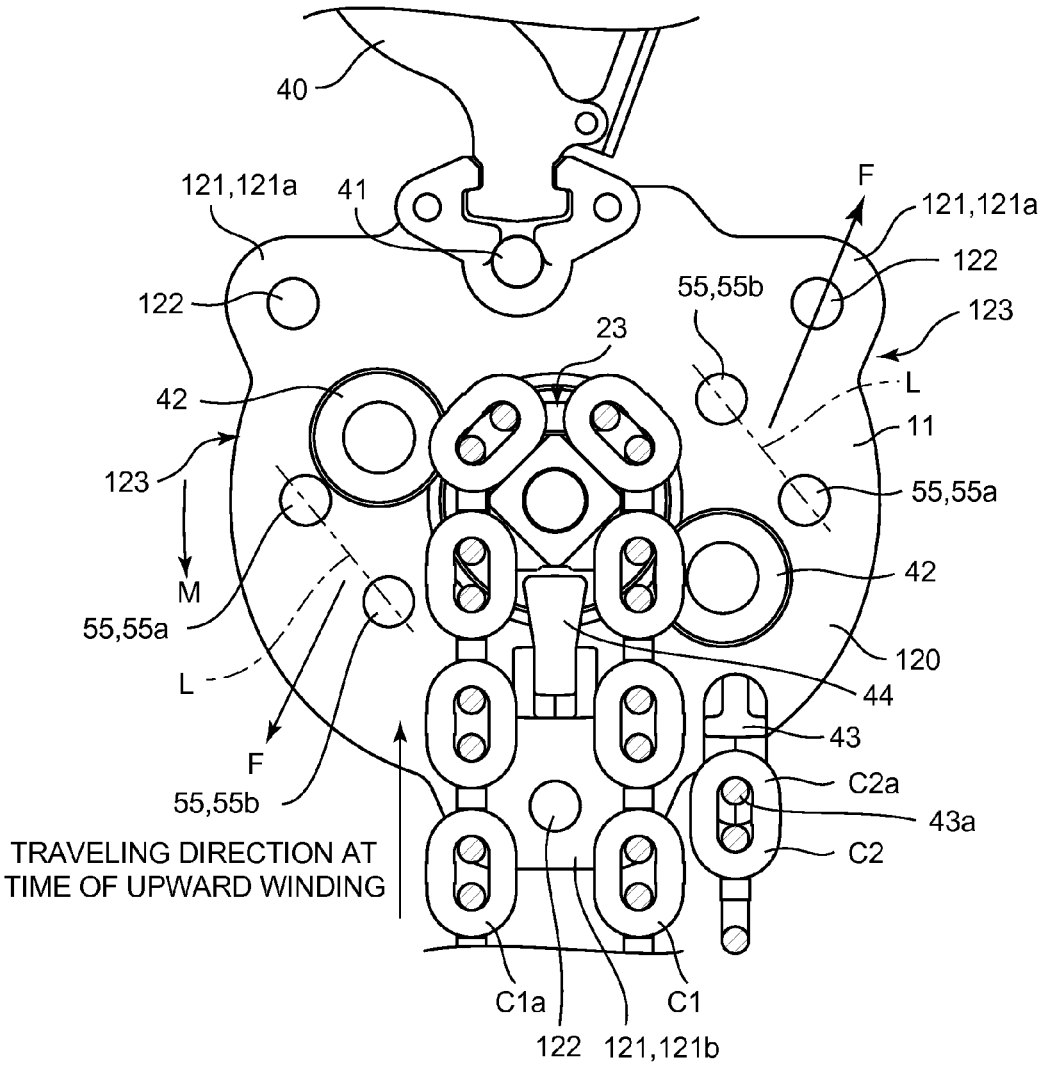
FIG. 7 is a diagram illustrating the positional relation of attaching positions of a fixation member and a guide roller with respect to a first frame in the chain block in FIG. 1.
Figure 7:
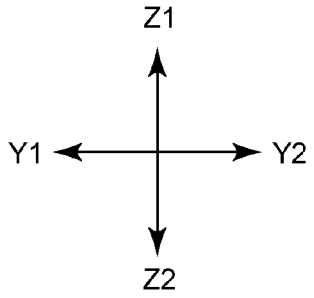

One end side and the other end side of the guide roller 42 illustrated in FIGS. 2 and 7 are shaft-supported rotatably with respect to the first frame 11 and the second frame 12, respectively. For example, a pair of guide rollers 42 are provided at an interval of 180 degrees with the center of the load-sheave hollow shaft 20 interposed therebetween. The guide roller 42 is a member which rotates as the load chain C1 is wound up or the like, and mounted facing the load sheave 23 and being separated by a distance to prevent the load chain C1 from coming off the chain pocket 23*b*.

The metal fastener 43 illustrated in FIGS. 1 to 3 and 8 is a portion to which a metal fitting pin 43*a* is mounted, and the metal fitting pin is inserted into the metal hoop C1*a* in an end portion of the load chain C1, which is opposite to the side to which the lower hook 45 is mounted. One end side and the other end side of the metal fastener 43 are also shaft-supported rotatably with respect to the first frame 11 and the second frame 12, respectively.

The stripper 44 illustrated in FIG. 3 is a member that prevents the occurrence of a lock state in which the load chain C1 looped over the load sheave 23 follows the load sheave 23 more than necessary and the load sheave 23 is stuck. Respective end portions on one end side and the other end side of the stripper 44 are inserted into respective support holes 11*b* and 12*b* existing in the first and second frames 11 and 12, and thus the stripper 44 is mounted to the first and second frames 11 and 12.

Figure 5:
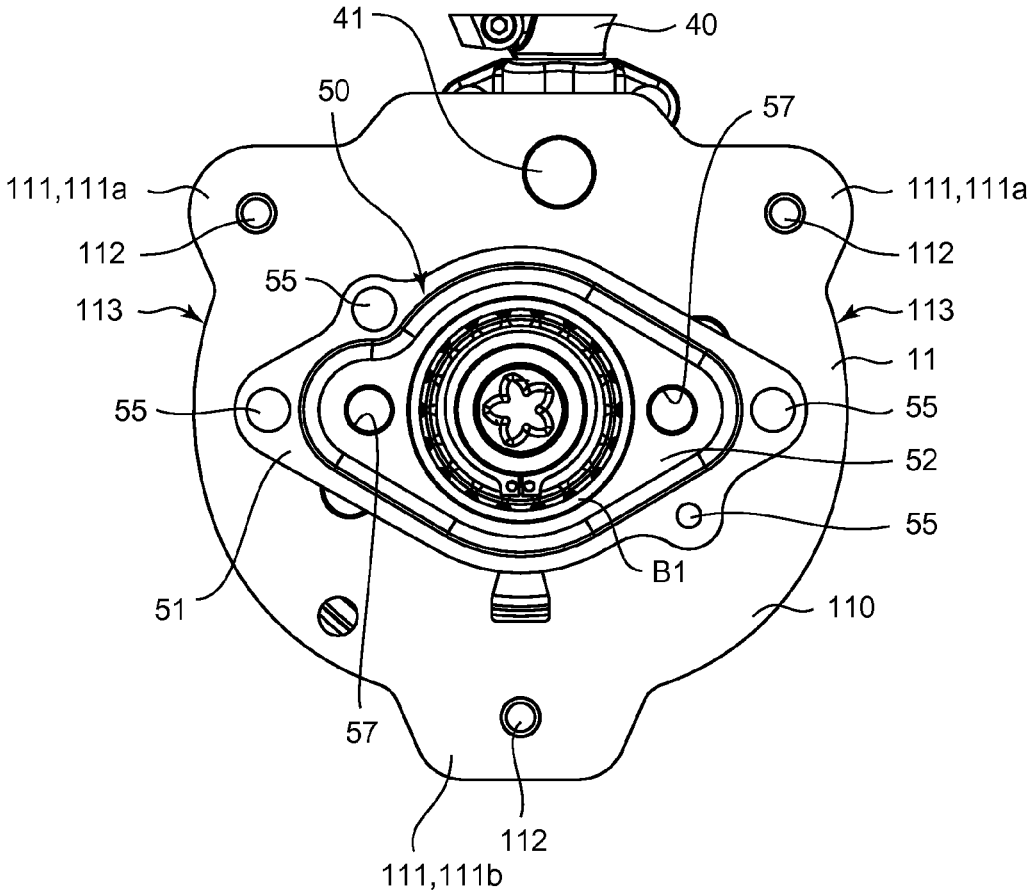
FIG. 5 is a front view illustrating the shapes of a first frame and an auxiliary plate in a state where a reduction gear member and a load gear are removed from the chain block in FIG. 1.
Figure 5:
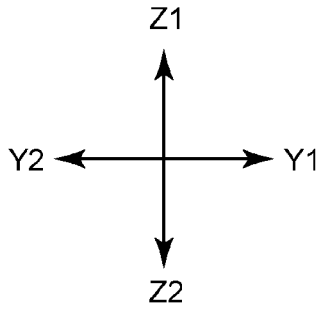
Figure 6A:
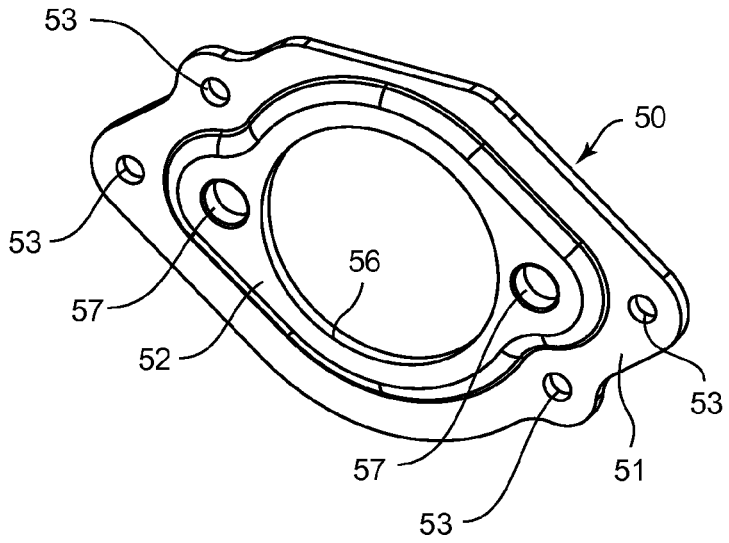
FIG. 6A is a perspective view illustrating the shape of the auxiliary plate in the chain block in FIG. 1, when seen from the front side.
Figure 6B:
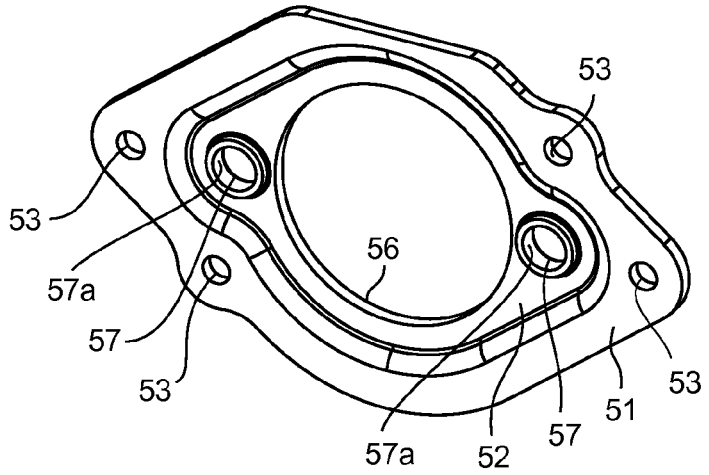
FIG. 6B is a perspective view illustrating the shape of the auxiliary plate in the chain block in FIG. 1, when seen from the rear side.

Furthermore, as illustrated in FIGS. 3 to 5, an auxiliary plate 50 illustrated in FIGS. 6A and 6B is mounted to an end surface on the side facing the gear case 13 of the first frame 11. The auxiliary plate 50 is provided with a flange portion 51 and a drawing portion 52. The flange portion 51 is a portion that comes in contact with the end surface of the first frame 11, and the flange portion 51 is provided with a fixation hole 53. Then, the auxiliary plate 50 is mounted to the first frame 11 by inserting a fixation member 55 such as a rivet (refer to FIG. 4) into the fixation hole 53 and a mounting hole 11*c* provided in the first frame 11. Furthermore, the drawing portion 52 is a portion positioned closer to the center side than the flange portion 51, and is a portion formed by, for example, drawing the center side of the auxiliary plate 50 so as to be spaced by a predetermined distance from the end surface of the first frame 11. In the present embodiment, the drawing portion 52 has a recessed portion existing on the outer peripheral side thereof due to the existence of the fixation hole 53 in the configuration illustrated in FIGS. 5, 6A, and 6B; however, the drawing portion 52 has a corner formed in an R-shaped approximately rhombic shape, except the recessed portion.

Here, the mounting positions of the above-described fixation member 55 and the guide roller 42 with respect to the first frame 11 are in a positional relation illustrated in FIG. 7. That is, the pair of guide rollers 42 are mounted adjacent to respective fixation members 55, and arranged at symmetrical positions with the center interposed between the guide rollers 42. Furthermore, the guide rollers 42 are provided adjacent to the fixation members 55 (55*a*) separated from the rotation center of the load sheave 23 or the like, and are also provided at positions spaced apart from the fixation members 55 (55*b*) close to the center with the Y direction interposed therebetween. In such an arrangement, when the load chain C1 is wound up, the entire chain block 10 tends to rotate along a rotation direction M of FIG. 7 such that a direction F of a force received from the load chain C1 becomes a direction orthogonal to a line L connecting the fixation members 55 adjacent to each other. In such rotation, when the guide rollers 42 are arranged as illustrated in FIG. 7, a line connecting the pair of guide rollers 42 approaches the horizontal state, and a guide property of the load chain can favorably be maintained.

Furthermore, as illustrated in FIGS. 5, 6A, and 6B, a central hole 56 is provided on the center side of the drawing portion 52. The central hole 56 is provided on the same axis as the above-described insertion hole 11*a*, and has the same diameter as that of the insertion hole 11*a*. Then, the above-described bearing B1 is positioned in the central hole 56 to support the load-sheave hollow shaft 20. Furthermore, the drawing portion 52 is provided with a bearing hole 57 along a diagonal in the longitudinal direction of the approximately rhombic shape thereof. For example, a pair of bearing holes 57 are provided at positions by an equal distance from the center of the central hole 56, and are each formed in a shape having a rising portion 57*a* by burring processing, for example. A shaft support portion 63 on one end side of the reduction gear member 60 (X1 side in FIG. 4) is inserted into the bearing hole 57, and the reduction gear member 60 is shaft-supported by the bearing hole. Note that a shaft support portion 64 on the other end side of the reduction gear member 60 (X2 side in FIG. 4) is inserted into a bearing hole 13*a* of the gear case 13 through a bearing B4 such as a bush, and the reduction gear member 60 is shaft-supported by the bearing hole 13*a*.

Figure 8:
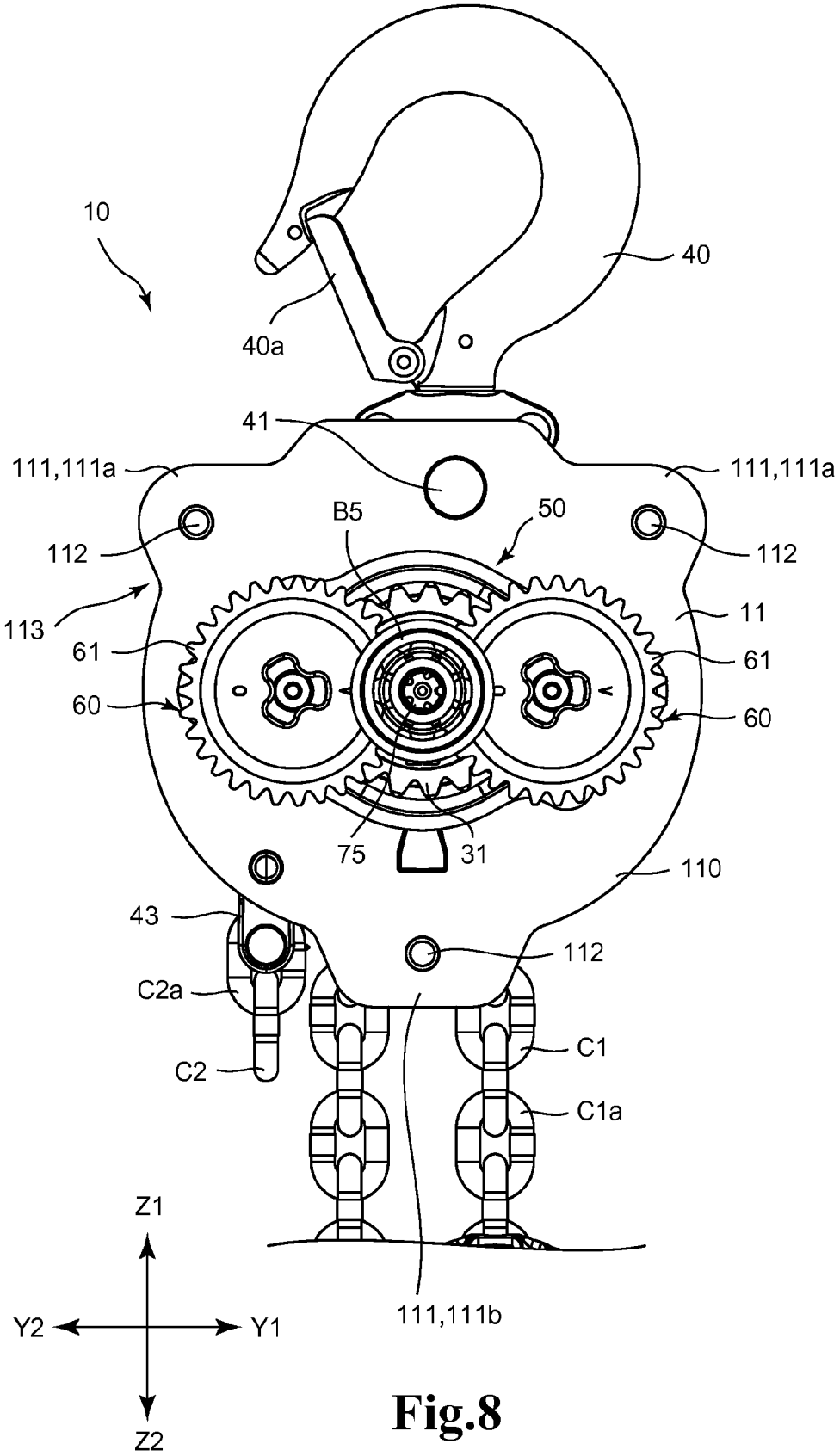
FIG. 8 is a diagram illustrating an arrangement of a reduction gear member and a load gear with respect to the first frame in the chain block in FIG. 1.
Figure 9A:
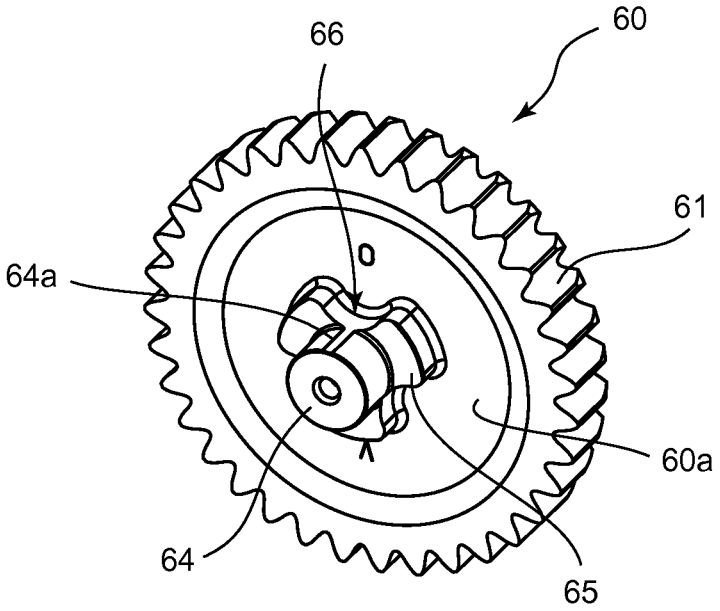
FIG. 9A is a perspective view illustrating the shape of the reduction gear member in the chain block in FIG. 1, when seen from the front side.
Figure 9B:
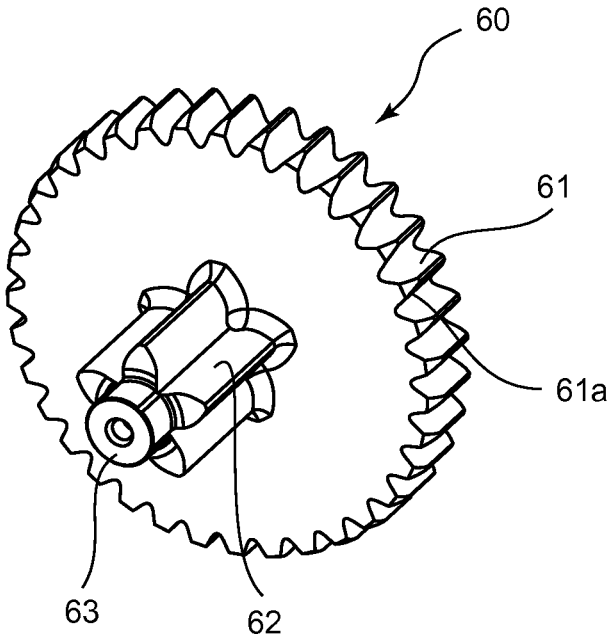
FIG. 9B is a perspective view illustrating the shape of the reduction gear member in the chain block in FIG. 1, when seen from the rear side.

As illustrated in FIGS. 4, 9A, and 9B, each of a pair of reduction gear members 60 (the arrangement of the pair of reduction gear members 60 is also illustrated in FIG. 8) is provided with the large-diameter gear 61 (corresponding to a first reduction gear member) and a small-diameter gear 62 (corresponding to a second reduction gear member), and is also provided with the shaft support portion 63 inserted into the bearing hole 57 and the shaft support portion 64 inserted into the bearing hole 13*a* as described above. The large-diameter gear 61 engages with a pinion gear 72 of the drive shaft 70, and a driving force is transferred from the drive shaft 70 to the reduction gear member 60 at a first reduction gear ratio. Furthermore, the large-diameter gear 61 is provided with a chamfered surface portion 61*a*. The chamfered surface portion 61*a* is provided at a site on the X1 side of the outer peripheral side of the large-diameter gear 61, and is provided having a smaller diameter than that of another site of the large-diameter gear 61. The existence of the chamfered surface portion 61*a* prevents the large-diameter gear 61 from interfering with an inclined portion 73 and a curved surface portion 74 of the drive shaft 70.

Furthermore, the small-diameter gear 62 engages with the load gear 31, and the driving force transferred to the reduction gear members 60 is transferred to the load gear 31 at a second reduction gear ratio. Note that the small-diameter gear 62 and the above-described large-diameter gear 61 are integrally formed by cold forging, for example. However, the small-diameter gear 62 and the large-diameter gear 61 may be integrally formed by a combination of other processing such as precise forging and cutting, and may be separately formed by a combination of the above-described processing and thereafter coupled to each other.

As illustrated in FIG. 9A, a swelling portion 65 is provided closer to the large-diameter gear 61 side (X1 side) than the shaft support portion 64 of the reduction gear member 60. The swelling portion 65 is provided in a concave portion 60*a* provided in a central portion of an end surface of the reduction gear member 60, but the swelling portion 65 is a portion swelling toward the outside in the radial direction so as to have a larger diameter than that of the shaft support portion 64, and is intermittently swelling along the peripheral direction (in FIG. 9A, three swelling portions 65 are provided). Then, a recessed portion 66 having a relatively smaller diameter than that of the swelling portion 65 exists between the adjacent swelling portions 65. Furthermore, the outer peripheral side of the shaft support portion 64 is provided with an oil groove 64*a* along the axial direction (X direction) of the reduction gear member 60, and the oil groove 64*a* is in communication with any one of recessed portions 66. Thereby, machine oil (grease) can be supplied to the bearing B4 such as a bush through the concave portion 60*a* and the oil groove 64*a*. Furthermore, the existence of the above-described swelling portion 65 can make the large-diameter gear 61 spaced apart from the bearing B4, and the existence of the concave portion 60*a* and the oil groove 64*a* can reduce a mechanical loss caused by the viscosity of the machine oil (grease) between the large-diameter gear 61 and bearings B4 and B5, and improve the fluidity of the machine oil (grease).

As illustrated in FIGS. 3 and 4, the drive shaft 70 (refer to FIGS. 10A to 10C) is a member extending from the gear case 13 side to the hand wheel 80 side along the X direction. The drive shaft 70 is inserted into the hollow hole 24 of the load-sheave hollow shaft 20 as described above, and provided rotatably with respect to the load sheave 23 through the bearing B3 at the bearing stepped portion 26. Furthermore, the drive shaft 70 is provided with the flange portion 71, and the flange portion 71 is positioned in the receiving concave portion 27. Then, by a plane portion 71*a* of the flange portion 71 (see also FIG. 10C) received in a bottom portion 27*a* of the receiving concave portion 27, the drive shaft 70 is restricted from moving toward the hand wheel 80 side, and the dimension in the axial direction of the drive shaft 70 can be reduced. The plane portion 71*a* is provided on a side of flange portion 71 opposite to gear portion 72, and extends in a radial direction from the drive shaft 70.

Figure 11A:
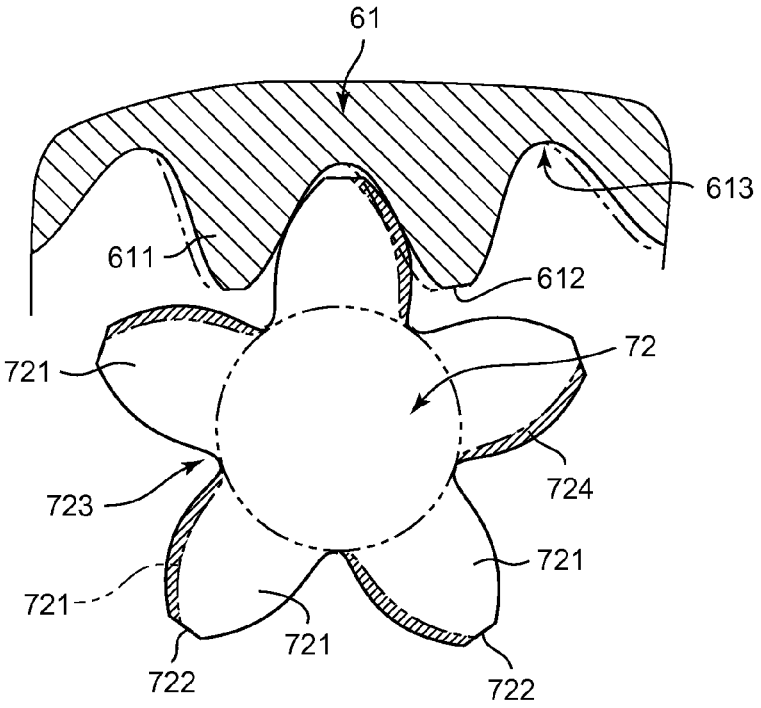
FIG. 11A illustrates an engagement state between a pinion gear and a large-diameter gear according to the present embodiment.
Figure 11B:
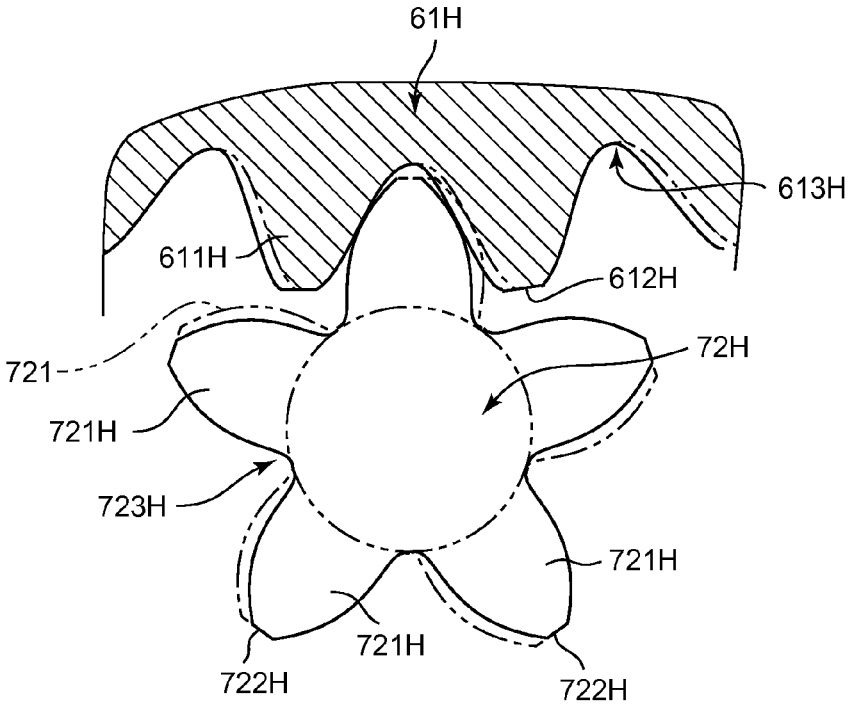
FIG. 11B illustrates an engagement state between a pinion gear and a large-diameter gear according to a configuration of the related art.

A portion protruding from the hollow hole 24 toward the gear case 13 side (X2 side) of the drive shaft 70 is provided with the pinion gear 72 (corresponding to a first gear) engaging with the above-described large-diameter gear 61. In FIG. 11A, a thickness Da of each tooth 721 of the pinion gear 72 is set to be different from a thickness Db of a tooth 721H of a pinion gear 72H according to the related art as illustrated in FIG. 12B. That is, in the pinion gear 72 according to the present embodiment, the thickness Da of a tooth tip 722 of each tooth 721 (hereinafter, the thickness Da of the tooth tip 722 is referred to as a thickness Da2 as illustrated in FIG. 12A) is provided to be larger than the thickness Db of a tooth tip 722H of each tooth 721H according to the related art (hereinafter, the thickness Db of the tooth tip 722H is referred to as a thickness Db2 as illustrated in FIG. 12B).

Note that, as described above, when the thickness Da2 of the tooth tip 722 is made larger than the thickness Db2 of the tooth tip 722H according to the related art, the thickness Da of each tooth 721 can be made as follows. That is, in the pinion gear 72 according to the present embodiment, a dimension Ba (not illustrated) of a tooth bottom 723 existing between the neighboring teeth 721 is provided to be smaller than a dimension Bb (not illustrated) of a tooth bottom 723H of the pinion gear 72H according to the related art. Thus, on the tooth bottom 723 side, the thickness Da of the tooth 721 (hereinafter, the thickness Da on the tooth bottom 723 side is referred to as a thickness Da1 as illustrated in FIG. 12A) is provided to be larger than the thickness Db of the tooth 721 according to the related art (hereinafter, the thickness Db on the tooth bottom 723H side is referred to as a thickness Db1 as illustrated in FIG. 12B).

Figure 12A:
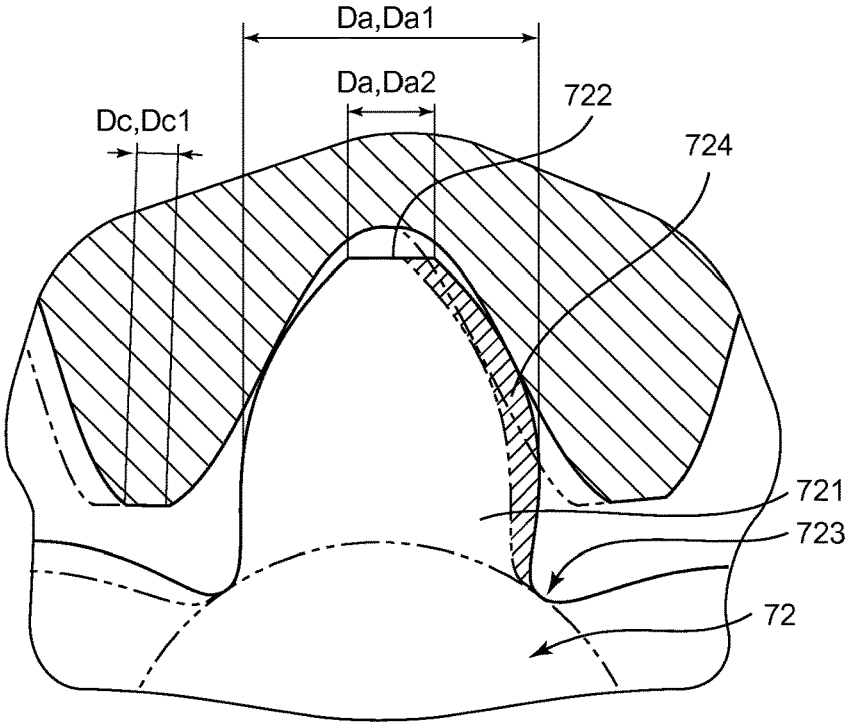
FIG. 12A is a diagram illustrating the relation in tooth thickness between the pinion gear and the large-diameter gear according to the present embodiment.
Figure 12B:
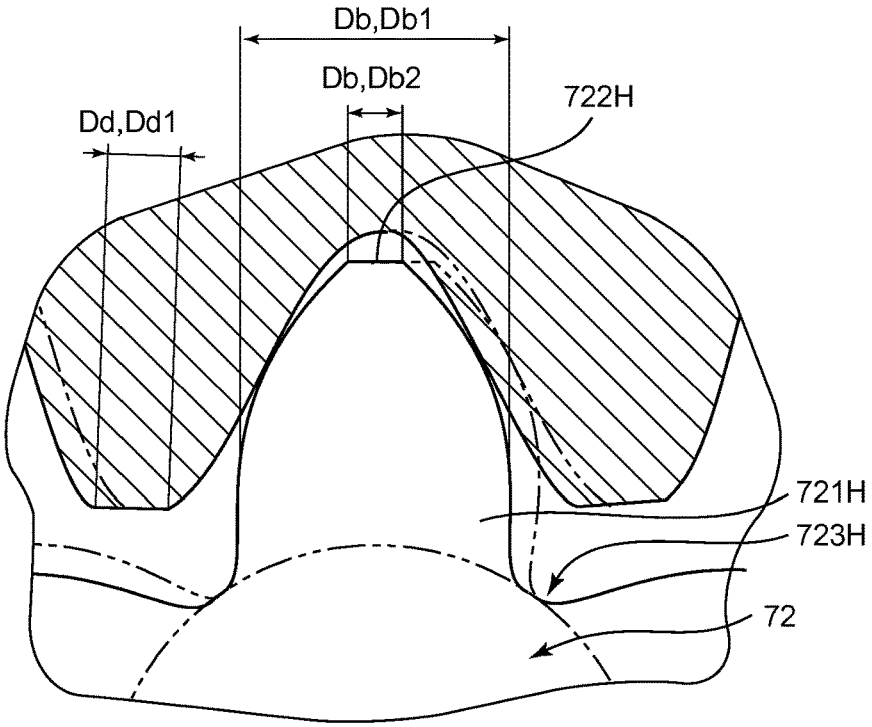
FIG. 12B is a diagram illustrating the relation in tooth thickness between the pinion gear and the large-diameter gear according to the configuration of the related art.

In addition, the thicknesses Da and Db at each site of the teeth 721 and 712H are considered as illustrated in FIGS. 12A and 12B. In this case, in the configuration illustrated in FIG. 12A, the ratio of a thickened portion 724 in the tooth thickness Da of the tooth 721 in the present embodiment is set to increase from the side of the tooth bottom 723 to a side of the tooth tip 722, as compared with the tooth thickness Db of the tooth 721H in the related art. Accordingly, since the ratio of the thickened portion 724 is larger on the side of the tooth tip 723, strength of the tooth 721 on the side of the tooth tip 723 can be improved significantly.

Note that the thickness Da of each tooth 721 may be set as follows. That is, the thickness Da1 on the tooth bottom 723 side may be set to be equal to the thickness Db1 on the tooth bottom 723H side of the tooth 721H according to the related art. In this case, however, it is necessary to prevent an undercut from occurring on the tooth bottom 723 side. Note that, when the thickness Da1 on the tooth bottom 723 side is provided as described above to be equal to the thickness Db1 on the tooth bottom 723H side of the tooth 721H according to the related art, the dimension of the thickened portion 724 may be set to become large from the tooth bottom 723 toward the tooth tip 722.

Furthermore, each tooth 611 of the large-diameter gear 61 engaging with the pinion gear 72 as described above is thinned by an amount corresponding to thickening of the thickened portion 724 of the tooth 721. That is, in the large-diameter gear 61, a tooth thickness Dc (refer to FIG. 12A) of the tooth 611 is smaller than a tooth thickness Dd (refer to FIG. 12D) of the tooth 611H according to the related art as much as the increasing amount from the tooth thickness Db of the tooth 721H of the pinion gear 72H according to the related art to the tooth thickness Da of the tooth 721 of the pinion gear 72. At this time, the thickness Da2 of the tooth tip 722 of the pinion gear 72 is provided to be larger than the thickness Dc1 of the tooth tip 612 of the large-diameter gear 61. Here, in a portion where the tooth 721 and the tooth 611 come in contact with each other, the change in the thickness Da of the tooth 721 from the tooth bottom 723 side to the tooth tip 722 side in the pinion gear 72 (the thickened portion 724) corresponds to the change in the thickness Dc of the tooth 611 from the tooth tip 612 side to the tooth bottom 613 side in the large-diameter gear 61. Thereby, the favorable engagement between the pinion gear 72 and the large-diameter gear 61 is realized.

Meanwhile, in the configuration illustrated in FIGS. 11A, 11B, 12A, and 12B, the pinion gear 72 is provided with the five teeth 721, and the large-diameter gear 61 is provided with 35 teeth 611. Moreover, a pair of large-diameter gears 61 (reduction gear member 60) are arranged at symmetrical positions with the pinion gear 72 interposed therebetween, and the pinion gear 72 is engaged with both of the pair of large-diameter gears 61. Thus, when the tooth 611 of the large-diameter gear 61 rotates once, the tooth 611 of the large-diameter gear 61 comes in contact with the tooth 721 of the pinion gear 72 only once; however, during one rotation of the large-diameter gear 61, the tooth 721 of the pinion gear 72 comes in contact with the tooth 611 of the large-diameter gear 61 fourteen times.

Furthermore, each of the reduction gear member 60 and the drive shaft 70 is made of a metal and is preferably made of an iron-based metal from a viewpoint of abrasion resistance. Furthermore, the reduction gear member 60 and the drive shaft 70 are preferably made of similar materials. However, at least the pinion gear 72 of the drive shaft 70 may be made of a material having wear resistance more excellent than that of the large-diameter gear 61 of the reduction gear member 60.

Figure 10A:
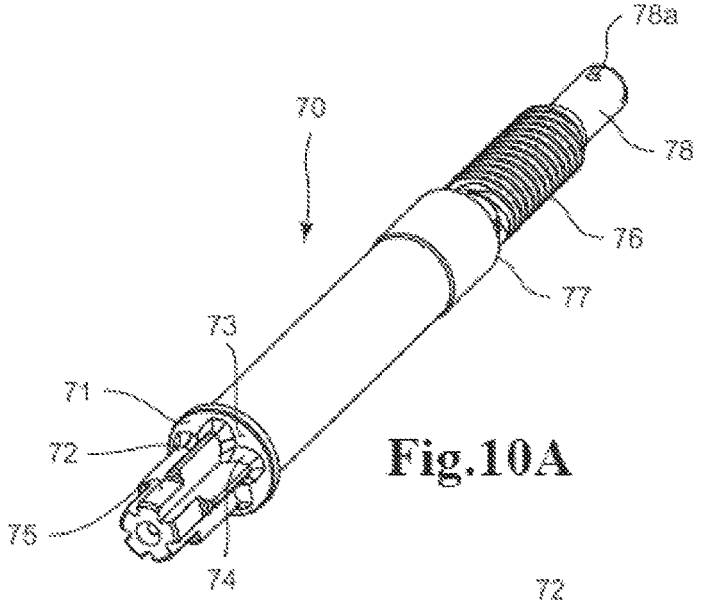
FIG. 10A is a perspective view illustrating the shape of a drive shaft in the chain block in FIG. 1, when seen from the front side.
Figure 10B:
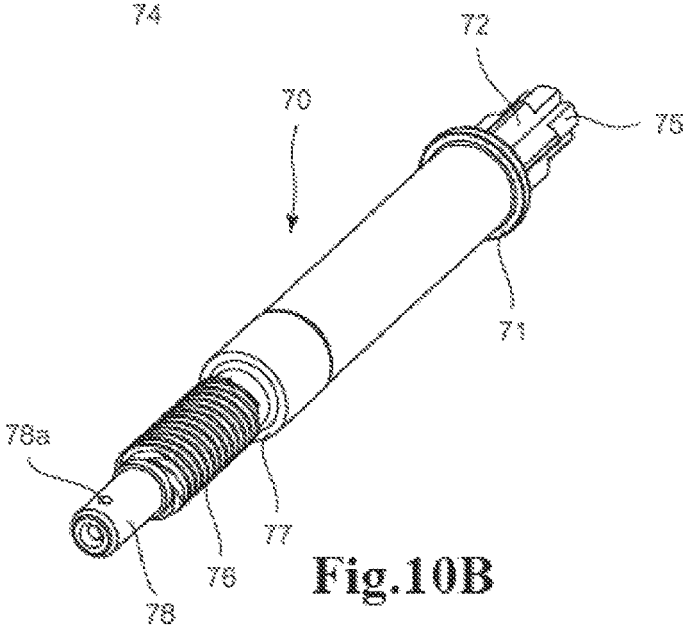
FIG. 10B is a perspective view illustrating the shape of the drive shaft in the chain block in FIG. 1, when seen from the rear side.
Figure 10C:
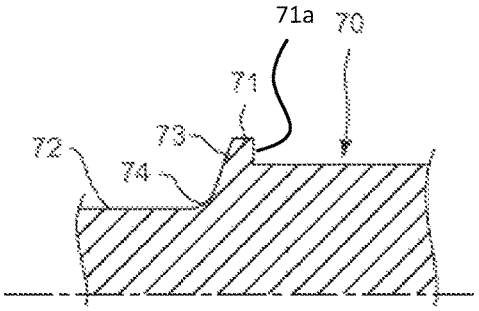
FIG. 10C is a partial expanded side cross-sectional view of the drive shaft in the chain block in FIG. 1, illustrating the shape of the vicinity of a flange portion.

A portion protruding from the hollow hole 24 toward the gear case 13 side (X2 side) of the drive shaft 70 is provided with the pinion gear 72 (corresponding to a gear portion) engaging with the above-described large-diameter gear 61. As illustrated in FIGS. 10A and 10C, a base portion of the pinion gear 72 with respect to the flange portion 71 is provided with the inclined portion 73. Further, the predetermined curved surface portion 74 is provided between each tooth of the pinion gear 72 and the inclined portion 73. The curved surface portion 74 is formed in a round shape, for example. Then, the existence of the inclined portion 73 and the curved surface portion 74 can prevent concentration of stress from occurring in a boundary portion between the pinion gear 72 and the flange portion 71. It is to be noted that the curved surface portion 74 has only to be 1/10 or larger of the inclined portion 73, and by setting the ratio thereof in the inclined portion 73 to 1/10 or larger, the stress concentration can be prevented favorably.

Here, the thickness on the tip side of the tooth of the pinion gear 72 is provided to be larger than the thickness on the tip side of the large-diameter gear 61 engaging with the pinion gear 72. Thus, the lifetime of the pinion gear 72 can be prolonged. That is, since the number of teeth of the pinion gear 72 is smaller than the number of teeth of the large-diameter gear 61, each tooth of the pinion gear 72 slides more times than each tooth of the large-diameter gear 61. Thereby, each tooth of the pinion gear 72 wears earlier than each tooth of the large-diameter gear 61. However, by setting the tooth thickness on the tip end side of the tooth of the pinion gear 72 to be larger than the tooth thickness on the tip end side of the large-diameter gear 61 and setting the tooth width to be larger, lifetime of the pinion gear 72 can be prolonged.

Furthermore, the drive shaft 70 is provided with a shaft support portion 75 closer to the gear case 13 side (X2 side) than the pinion gear 72. The shaft support portion 75 is a portion to which the bearing B5 is mounted on the outer peripheral side thereof, and the bearing B5 is mounted to a bearing mounting portion 13*b* provided in the gear case 13. Thereby, an end portion on the X2 side of the drive shaft 70 is rotatably supported by the gear case 13 through the bearing B5. Further, a male screw portion 76 is provided on the hand wheel 80 side of the drive shaft 70. The male screw portion 76 is a portion to which a female screw portion 81 of the hand wheel 80 or a female screw portion 91*a* of a brake receiving portion 91, which will be described below, are screwed. Note that an end portion on the X2 side of the male screw portion 76 is provided with a stepped portion 77, and the brake receiver 91 to be described below is locked by the stepped portion 77. Furthermore, a stopper receiving portion 78 having a pin hole 78*a* is provided closer to the X1 side than the male screw portion 76, and a wheel stopper 84 to be described below is arranged in the stopper receiving portion 78 and retained by a stopper pin 79.

Note that the gear case 13 is a member that covers the speed reducing mechanism 30 such as the reduction gear member 60 and the load gear 31, and the gear case 13 is fixed to the first frame 11 via the stud bolt SB and the nut N.

As illustrated in FIGS. 3 and 4, an end surface of the second frame 12 on the side not facing the first frame 11 is provided with the hand wheel 80 and a brake mechanism 90. The hand wheel 80 has the female screw portion 81 on a center side thereof, and this female screw portion 81 is screwed to the male screw portion 76 of the drive shaft 70. Furthermore, a chain pocket 82 similar to the above-described load sheave 23 is provided on an outer peripheral side of the hand wheel 80. The chain pocket 82 is a portion into which a metal hoop C2*a* of a hand chain C2 is fitted, and has a horizontal pocket (not illustrated) into which the metal hoop C2*a* is fitted in a state where the direction in which the metal hoop C2*a* becomes flat is parallel to the axial direction, and a vertical pocket (not illustrated) which has a deeper groove shape than the horizontal pocket and into which the metal hoop C2*a* is fitted in a state where the direction in which the metal hoop C2*a* becomes flat crosses the axial direction. Note that the wheel stopper 84 is provided closer to the tip side of the male screw portion 76 (X1 side) than the hand wheel 80 via a collar 83 or the like. The wheel stopper 84 is a ring-shaped member and has a through-hole 84*a* along the radial direction. Then, by inserting a stopper pin 85 into the through-hole 84*a* and the pin hole 78*a* of the stopper receiving portion 78, the wheel stopper 84 is restricted from moving in the X direction of the drive shaft 70. The existence of the wheel stopper 84 restricts the hand wheel 80 from moving to the X1 side.

Furthermore, the brake mechanism 90 includes the brake receiver 91, a brake plate 92, a ratchet wheel 94, a pawl member 95, and like as main components. As illustrated in FIGS. 3 and 4, the brake receiver 91 is arranged on the second frame 12 side of the male screw portion 76 of the drive shaft 70. The brake receiver 91 has the female screw portion 91*a* on the center side thereof, and further has a flange portion 91*b* and a hollow boss portion 91*c*. The female screw portion 91*a* is a portion that is screwed to the male screw portion 76 of the drive shaft 70, and the flange portion 91*b* of the brake receiver 91 is locked by the stepped portion 77 by the screwing of the female screw portion. The flange portion 91*b* is provided to have a larger diameter than that of the hollow boss portion 91*c*, and can receive the brake plate 92 to be described below. The hollow boss portion 91*c* is positioned closer to the hand wheel 80 side (X1 side) than the flange portion 91*b*, and supports the ratchet wheel 94 via a bush 93 to be described below.

The brake plate 92 (92*a*) is positioned between the flange portion 91*b* and the ratchet wheel 94 to be described below. When pressurized from the hand wheel 80 side, the brake plate applies a large frictional force between the flange portion 91*b* and the ratchet wheel 94 to be described below, and the brake receiver 91 integrally rotates with the ratchet wheel 94 by the large frictional force. Note that the brake plate 92 (92*b*) is also arranged between the ratchet wheel 94 and the hand wheel 80 and applies a large frictional force between the ratchet wheel 94 and the hand wheel 80 by being pressurized from the hand wheel 80, and the hand wheel 80 integrally rotates with the ratchet wheel 94 by the large frictional force.

Figure 13:
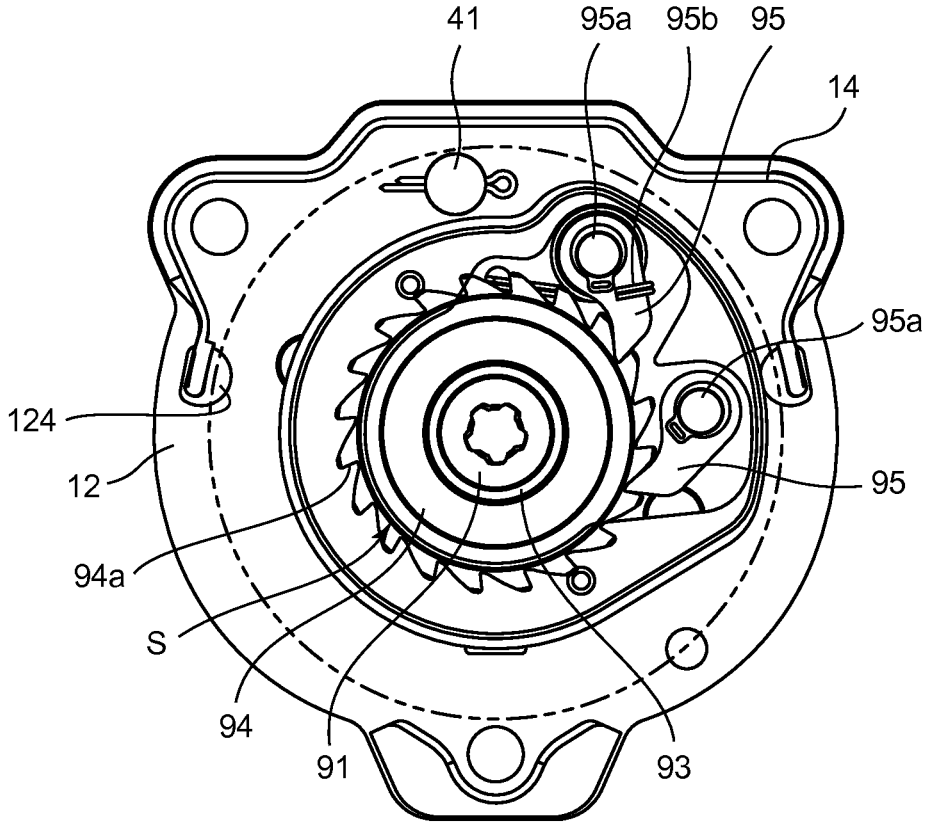
FIG. 13 is a diagram illustrating an arrangement of a ratchet wheel and pawl members in the chain block in FIG. 1.
Figure 13:
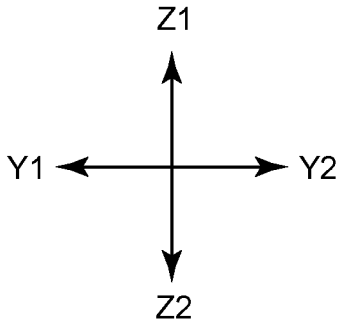

As illustrated in FIGS. 3 and 4, the bush 93 is mounted to the hollow boss portion 91*c* of the brake receiver 91, and the ratchet wheel 94 is provided on the outer peripheral side of the bush 93. Thereby, the ratchet wheel 94 is provided rotatably with respect to the brake receiver 91. As illustrated in FIG. 13, a tip end of each pawl member 95 engages with a tooth portion 94*a* of the ratchet wheel 94, and the engagement thereof forms a ratchet wheel mechanism which prevents the ratchet wheel 94 from rotating in the opposite direction (rotating in the winding-up direction). Note that the pawl member 95 is rotatably provided through a pawl shaft 95*a*, and one end of a biasing spring 95*b* is attached to the pawl member 95, so that a basing force is applied such that the tip of the pawl member 95 always engages with the tooth portion 94*a* of the ratchet wheel 94.

Furthermore, a pair of pawl member 95 are provided. In the configuration illustrated in FIG. 13, one pawl member 95 is arranged at a position where the pawl member is inclined at a predetermined angle such as 30 degrees to the vertical direction. Furthermore, the other pawl member 95 is provided at a position adjacent to the one pawl member 95. However, the arrangement mode thereof is an arrangement where the pair of pawl member 95 are both fitted into the same quadrant such as the first quadrant of the orthogonal coordinate system. Thereby, a space S is formed at a position corresponding to the third quadrant with respect to the first quadrant of the orthogonal coordinate system (a position on the Z2 side and the Y2 side in FIG. 13), and when the load chain C1*a* is wound up, the lower hook 45 can be positioned in the space S. However, other arrangements may be employed as the arrangement of the pair of pawl member 95, and for example, a configuration of arranging each of the pair of pawl members in a diagonal direction with the rotation center of the ratchet wheel 94 interposed therebetween may be employed.

Meanwhile, the wheel cover 14 is a member covering an upper side of the hand wheel 80 and an upper side of the brake mechanism 90 and is fixed on the second frame 12 via the stud bolts SB and the nuts N.

<2. Regarding Action of Chain Block>

In the chain block 10 of the above-described configuration, when the hand chain C2 is operated in the winding-up direction in a state where a load is hung on the lower hook 45, the hand wheel 80 rotates; however, at this time, due to the engagement of the female screw portion 81 with the male screw portion 76 of the drive shaft 70, the hand wheel 80 travels in the direction to pressurize the brake plate 92 (92*b*) (direction toward X2 in FIGS. 3 and 4) and strongly pressurizes the brake plate 92 (92*b*). Subsequently, the hand wheel 80 and the drive shaft 70 integrally rotate, and a driving force caused by the rotation is transferred to the load gear 31 through the pinion gear 72, the large-diameter gear 61, and the small-diameter gear 62 to rotate the load-sheave hollow shaft 20. Thereby, the load chain C1 is wound up and the load is lifted.

Conversely, when the lifted load is lowered, the hand chain C2 is driven in the opposite direction to when the load is lifted. Then, the hand wheel 80 releases the pressurization on the brake plate 92*b*. The drive shaft 70 rotates in the opposite direction to the winding-up direction of the load by an amount of the releasing. Thereby, the load is gradually lowered.

Note that, in a stopped state of the ratchet wheel 94, the tip of the pawl member 95 engages with the tooth portion 94*a* of the ratchet wheel 94. Moreover, even when the hands are released from the hand chain C2 at the time of winding-up to rotate the drive shaft 70 in the opposite direction by the action of gravity from the load, the brake plate 92*b* is pressed against the ratchet wheel 94 by the hand wheel 80 in a state where the hand wheel 80 does not rotate, and further the brake plate 92*a* is pressed against the flange portion 91*a* of the brake receiver 91 by the ratchet wheel 94. Thereby, a brake force resisting the gravity of the load is applied to prevent the load from being lowered.

<3. Regarding Effect>

According to the chain block 10 configured as above, on one end side of the hollow hole 24 of the load-sheave hollow shaft 20 is provided the receiving concave portion 27 including the bottom portion 27*a* on which the flange portion 71 of the drive shaft 70 abuts. Accordingly, movement of the drive shaft 70 to the side of the hand wheel 80 is regulated, and the dimension of the drive shaft 70 in the axial direction (X direction) can be reduced. Since the dimension of the drive shaft 70 in the X direction is reduced, size reduction of the chain block 10 can be achieved as much, and weight reduction of the chain block 10 can be achieved. Also, since the dimension of the drive shaft 70 in the axial direction (X direction) is reduced, strength of the drive shaft 70 against torsion, shear, and the like can be improved as much as the reduced amount of the dimension.

Also, the flange portion 71 is provided with the inclined portion 73. Thus, existence of the inclined portion 73 can prevent stress concentration from being generated on the base end part of the pinion gear 72 on the side of the flange 71 and can prevent the teeth of the pinion gear 72 from cracking. Also, since the large-diameter gear 61 of the reduction gear member 60 is provided with the chamfered surface portion 61*a*, the large-diameter gear 61 can be prevented from interfering with the inclined portion 73 and the like of the drive shaft 70. Also, existence of the chamfered surface portion 61*a* enables the reduction gear member 60 to be arranged in proximity to the side of the flange portion 71. That is, existence of the chamfered surface portion 61*a* enables the dimension of the chain block 10 in the X direction to be reduced, and size reduction of the chain block 10 can be achieved.

Also, in the present embodiment, the load gear 31 is provided with the concave portions 31*b* (31*b*1 and 31*b*2) formed by denting both the end surfaces of the load gear 31 to a certain extent. Since the concave portion 31*b*1 is opposed to the bearing B1, the space between the load gear 31 and the bearing B1 can be enlarged. Thus, in a case in which the load gear 31 is rotated in a state in which machine oil (grease) exists between the load gear 31 and the bearing B1, a mechanical loss generated by viscosity of the machine oil (grease) can be reduced, and fluidity of the machine oil (grease) can be improved at the time of rotation of the load gear 31. Similarly, since the concave portion 31*b*2 is opposed to the large-diameter gear 61, the space between the load gear 31 and the large-diameter gear 61 can be enlarged. Thus, in a case in which the load gear 31 is rotated, a mechanical loss generated by viscosity of the machine oil (grease) can be reduced, and fluidity of the machine oil (grease) can be improved at the time of rotation of the load gear 31. In other words, existence of the concave portions 31 (31*b*1 and 31*b*2) enables resistance (mechanical loss) in driving (upward and downward winding) of the chain block 10 to be decreased and enables operability to be improved.

Further, in the present embodiment, the large-diameter gear 61 is provided with the swelling portions 65. Existence of the swelling portions 65 enables the large-diameter gear 61 to be away from the bearing B4. Also, at parts between the adjacent swelling portions 65 are provided the plurality of recessed portions 66, on the outer circumferential side of the shaft support portion 64 is provided the oil groove 64*a*, and this oil groove 64*a* communicates with any of the recessed portions 66. This enables the machine oil to be supplied to the bearing B4 such as a bush via the oil groove 64*a*. Also, existence of the oil groove 64*a* enables fluidity of the machine oil (grease) to be improved. Accordingly, a mechanical loss generated by viscosity of the machine oil (grease) can be reduced at the time of rotation of the large-diameter gear 61, and operability can be improved.

Also, in the present embodiment, the tooth thickness Da2 of the tooth tip 722 of the pinion gear 72 is set to be larger than the tooth thickness Dc1 of the tooth tip 612 of the large-diameter gear 61. This enables strength of the teeth 721 of the pinion gear 72 to be improved and enables durability of the pinion gear 72 to be improved. That is, since the number of the teeth 721 of the pinion gear 72 is smaller than the number of the teeth 611 of the large-diameter gear 61, the teeth 721 of the pinion gear 72 are abraded easily. Thus, in the conventional pinion gear 72H, the tooth tips 722 of the teeth 721H are cracked easily due to abrasion of the teeth 721H.

However, as described above, in the case in which the tooth thickness Da2 of the tooth tip 722 of the pinion gear 72 is set to be larger than the tooth thickness Db2 of the tooth tip 722H of the conventional pinion gear 72H, and in which the tooth thickness Da2 of the tooth tip 722 of the pinion gear 72 is set to be larger than the tooth thickness Dc1 of the tooth tip 612 of the large-diameter gear 61, durability of the teeth 721 against abrasion can be improved. Accordingly, lifetime of the chain block 10 can be extended, and reliability of the chain block 10 can be improved.

Also, in the present embodiment, the tooth thickness Da of the tooth 721 of the pinion gear 72 is set to be larger than the conventional tooth thickness Db, and the tooth thickness Dc of the tooth 611 of the large-diameter gear 61 is set to be smaller than the conventional tooth thickness Dd. Accordingly, the tooth tips 722 of the teeth 721 of the pinion gear 72 can be prevented from cracking effectively.

Further, in the present embodiment, the flange portion 71 is provided on the base end side (X1 side) of the pinion gear 72 and is provided to be continuous with the teeth 721. Thus, strength of each tooth 721 of the pinion gear 72 can be increased.

Further, in the present embodiment, the pair of reduction gear members 60 is provided, and both the reduction gear members 60 as a pair mesh with the pinion gear 72. The reduction gear members 60 as a pair are arranged at symmetric positions with the pinion gear 72 interposed therebetween. In this case, the teeth 721 of the pinion gear 72 are in a state of being abraded earlier. However, even in this case, by setting the tooth thickness Da of the tooth tip 722 to be large as described above, the tooth tips 722 of the teeth 721 of the pinion gear 72 can be prevented from cracking effectively.

Further, in the present embodiment, the guide rollers 42 as a pair are arranged at symmetric positions with a rotation center of the drive shaft 70 interposed therebetween and are arranged so that, as a result of entire turning in load hoisting with use of the load chain C1, the line connecting the guide rollers 42 as a pair may be further nearly horizontal than in an unloaded case in the load hoisting. Accordingly, the load chain C1 can be fed favorably by the guide rollers 42 even in a loaded state, and it is possible to prevent a problem in which the load chain C1 comes off of the load sheave 23 from occurring.

Also, in the present embodiment, as illustrated in FIG. 7, as a result of entire turning of the chain block 10 in load hoisting with use of the load chain C1, the line L connecting the fixation members 55 as a pair is arranged at a position of further approaching to a direction perpendicular to the acting line F of a force at the time of load hoisting than in the unloaded case. Accordingly, forces applied to the respective fixation members 55 can be distributed favorably, and it is possible to prevent a case in which a significant load is applied to a specific fixation members 55 from occurring.

<4. Modification>

Hereinabove, the embodiment of the present invention has been described, but the present invention can be modified in various manners other than the above-described embodiment. Hereinafter, the modifications will be described.

In the above embodiment, the configuration of fixing the auxiliary plate 50 to the first frame 11 through the fixation hole 53 and the fixation member 55. However, for example, at least one combination of a boss hole and a boss may be used in place of the combination of the fixation hole 53 and the fixation member 55. In addition, an auxiliary plate 53 may be fixed to a first frame 11 by welding or the like.

REFERENCE SIGNS LIST

10 . . . Chain block
11 . . . First frame
12 . . . Second frame
13 . . . Gear case
14 . . . Wheel cover
20 . . . Load-sheave hollow shaft
23 . . . Load sheave

24 . . . Hollow hole
25 . . . Bearing step
27 . . . Receiving concave portion
27*a* . . . Bottom portion
30 . . . Speed reducing mechanism
31 . . . Load gear
31*b*, 31*b*1, 31*b*2 . . . Concave portion
40 . . . Upper hook
42 . . . Guide roller
43 . . . Metal fastener
44 . . . Stripper
45 . . . Lower hook
50 . . . Auxiliary plate
51 . . . Flange portion
52 . . . Draw forming portion
53 . . . Fixation hole
55 . . . Fixation members
57 . . . Bearing hole
60 . . . Reduction gear member
61 . . . Large-diameter gear (corresponding to first reduction gear)
61*a* . . . Chamfered surface portion
62 . . . Small-diameter gear (corresponding to second reduction gear)
64*a* . . . Oil groove
65 . . . Swelling portions
66 . . . Recessed portion
70 . . . Drive shaft
71 . . . Flange portion
72 . . . Pinion gear (corresponding to gear portion)
73 . . . Inclined portion
74 . . . Curved surface portion
76 . . . Male screw portion
77 . . . Stepped portion
80 . . . Hand wheel
90 . . . Brake mechanism
91 . . . Brake receiver
92 . . . Brake plate
94 . . . Ratchet wheel
95 . . . Pawl member
B1 to B5 . . . Bearing
C1, C2 . . . Load chain
N . . . Nut
S . . . Space
SB . . . Stud bolt

The invention claimed is:

1. A chain block comprising:

a load-sheave hollow shaft around which a load chain is wound, which includes a load sheave feeding the load chain along with rotation, and which includes a hollow hole passing therethrough along an axial direction;

a drive shaft which is inserted in the hollow hole, the drive shaft comprising:

on a first end side, a gear portion meshing with a reduction gear member, and on a base end side of the gear portion away from the first end side and adjacent to the gear portion, a flange portion projecting to an outer circumferential side, the flange portion being a largest diameter portion of the drive shaft and provided with a plane portion on a side opposite to the gear portion, the plane portion extending in a radial direction from the drive shaft; and the reduction gear member including a first reduction gear portion meshing with the gear portion, on a first end side of the hollow hole is provided a housing recess including a bottom portion on which the plane portion of the flange portion is situated and abuts, the flange portion is provided toward a center side in the radial direction with an inclined portion gradually inclined toward a side of the gear portion, a curved surface portion is provided between each tooth of the gear portion and the inclined portion so that the flange portion is continuous with the gear portion via the inclined portion and the curved surface portion;

on a side of the first reduction gear portion in proximity to the flange portion is provided a chamfered portion; and wherein the flange portion is integral with the drive shaft, and the inclined portion and the curved surface portion are provided at the side of the flange portion which does not abut the bottom portion.

2. The chain block according to claim 1, wherein the load-sheave hollow shaft is provided with a load gear meshing with a second reduction gear portion projecting out of the reduction gear member and rotated integrally with the load-sheave hollow shaft, and this load gear abuts in a state in which movement thereof along a second end side in the axial direction is regulated by a fixing step of the load-sheave hollow shaft, and wherein on a center side in the radial direction at least on one end surface side of the load gear is provided a recess further dented than on an outer circumferential side.

3. The chain block according to claim 2, wherein the reduction gear member is provided with the second reduction gear portion meshing with the load gear, the first reduction gear portion is integrally provided with expanding portions projecting from an end surface thereof opposite to the second speed reducing gear portion, and a pivotally supporting portion projects from the expanding portions toward a direction away from the first reduction gear portion, the expanding portions expand outward in the radial direction so as to have larger diameters than that of the pivotally supporting portion and expand intermittently along a circumferential direction, and between the adjacent expanding portions are provided a plurality of dented portions each having a smaller diameter than that of the expanding portion, on an outer circumferential side of the pivotally supporting portion is provided a groove along the axial direction of the reduction gear member, and this groove communicates with at least one of the dented portions.

4. The chain block according to claim 3, wherein a thickness of a tip of a tooth of the gear portion in the drive shaft is set to be larger than a thickness of a tip of a tooth of the first reduction gear portion of the reduction gear member.

5. The chain block according to claim 2, wherein a thickness of a tip of a tooth of the gear portion in the drive shaft is set to be larger than a thickness of a tip of a tooth of the first reduction gear portion of the reduction gear member.

6. The chain block according to claim 2, wherein to a first frame and a second frame is rotatably supported a pair of guide rollers guiding feeding of the load chain together with the load sheave, the guide rollers as a pair are arranged at symmetric positions with a rotation center of the drive shaft interposed therebetween, the guide rollers as a pair are arranged so that, in an unloaded case, a line connecting the guide rollers is inclined with respect to a horizontal reference line, and, in a loaded case in the load hoisting, the line connecting the guide rollers is less inclined with respect to the horizontal reference line than is the line in the unloaded case; and wherein a plate member is fixed to the first frame.

7. The chain block according to claim 6, wherein the load-sheave hollow shaft is pivotally supported in an insertion hole of the first frame, to the first frame is attached via fixing tools the plate member having a center hole provided coaxially with the insertion hole, the plate member is provided with a flange portion abutting on the frame member and a draw portion situated further on a center side than the flange portion and raised from the flange portion so as to be spaced apart from the frame member, the plate member is attached to the frame member at the flange portion via the fixing tools, a pair of the fixing tools is provided on each side with the rotation center of the drive shaft interposed therebetween, and the fixing tools as each pair are provided at positions such that a line connecting the fixing tools is less inclined with respect to a line perpendicular to an acting line of force when at a time of load hoisting than when in an unloaded case.

8. The chain block according to claim 1, wherein to a first frame and a second frame is rotatably supported a pair of guide rollers guiding feeding of the load chain together with the load sheave, the guide rollers as a pair are arranged at symmetric positions with respect to a rotation center of the drive shaft, the guide rollers as a pair are arranged so that, in an unloaded case, a line connecting the guide rollers is inclined with respect to a horizontal reference line, and, in a loaded case in the load hoisting, the line connecting the guide rollers is less inclined with respect to the horizontal reference line than is the line in the unloaded case; and wherein a plate member is fixed to the first frame.

9. The chain block according to claim 8, wherein the load-sheave hollow shaft is pivotally supported in an insertion hole of the first frame, to the first frame is attached via fixing tools the plate member having a center hole provided coaxially with the insertion hole, the plate member is provided with a flange portion abutting on the frame member and a draw portion situated further on a center side than the flange portion and raised from the flange portion so as to be spaced apart from the frame member, the plate member is attached to the frame member at the flange portion via the fixing tools, a pair of the fixing tools is provided on each side with the rotation center of the drive shaft interposed therebetween, and the fixing tools as each pair are provided at positions such that a line connecting the fixing tools is less inclined with respect to a line perpendicular to an acting line of force when at a time of load hoisting than when in an unloaded case.

* * * * *